United States Patent [19]

Scheinecker

[11] 4,173,251

[45] Nov. 6, 1979

[54] MOULD ARRANGEMENT TO BE USED IN A CONTINUOUS CASTING PLANT

[75] Inventor: Alois Scheinecker, Linz, Austria

[73] Assignee: Vereinigte Österreichische Eisen- und Stahlwerke-Alpine Montan Aktiengesellschaft, Linz, Austria

[21] Appl. No.: 819,377

[22] Filed: Jul. 27, 1977

[30] Foreign Application Priority Data

Aug. 5, 1976 [AT] Australia ..... 5799/76

[51] Int. Cl.[2] ..... B22D 11/04; B22D 11/12

[52] U.S. Cl. ..... 164/436; 164/442

[58] Field of Search ..... 164/89, 436, 441, 442, 164/447, 448, 427, 435

[56] References Cited

U.S. PATENT DOCUMENTS

| | | | |
|---|---|---|---|
| 2,284,503 | 5/1942 | Williams | 164/442 X |
| 3,516,479 | 6/1970 | Kurth et al. | 164/442 |
| 3,620,285 | 11/1971 | Olsson | 164/441 |
| 3,710,845 | 1/1973 | Burkhardt | 164/436 |
| 3,967,362 | 7/1976 | Capriotti | 164/442 X |
| 4,069,863 | 1/1978 | Hargassner | 164/436 |

*Primary Examiner*—Richard B. Lazarus
*Assistant Examiner*—John S. Brown
*Attorney, Agent, or Firm*—Brumbaugh, Graves, Donohue & Raymond

[57] ABSTRACT

A mould arrangement for continuous casting plants has a mould with side walls adjustable to various strand sizes, supporting devices below the mould for guiding the emerging strand, and holding devices releasable from above for securing the supporting devices to the mould. The supporting devices are arranged in hollow spaces extending through the mould side walls to the upper side thereof.

3 Claims, 2 Drawing Figures

MOULD ARRANGEMENT TO BE USED IN A CONTINUOUS CASTING PLANT

BACKGROUND OF THE INVENTION

The invention relates to a mould to be used in a continuous casting plant with side walls that are adjustable to different strand dimensions and with supporting means arranged below the mould for supporting the strand which emerges from the mould. The supporting means are secured to the mould by holding means such as bracing screws, drawing anchors or the like, which holding means are detachable from above.

The supporting means arranged at the lower side of the mould and reciprocating therewith carefully support the strand which at that point has only a very thin outer shell. The stationarily mounted supporting and guiding means follows this supporting means at a slight distance therefrom, which distance permits the reciprocating movement.

If a break-through of the strand occurs in the region slightly below the mould, it is first of all necessary to remove the mould. This, however, is difficult, since the steel that flows out through the break in the strand welds parts of the plant together. In particular the supporting means secured to the mould is welded to the stationary supporting and guiding means and to the strand, and skulls form. In order to be able to remove the mould in such a case without having to carry out manipulations with the mould, it is known to secure the supporting means to a plate and to secure the plate to the water box surrounding the side walls of the mould by means of carrying columns. In that case the carrying columns are guided through the water box and secured to it at its upper side. The disadvantage with this construction resides in the fact that during each change to a different size, not only the side walls of the mould have to be re-adjusted, but in addition the supporting means have to be re-adjusted. Thus work has to be carried out slightly below the mould in the space that is narrowed by the presence of the reciprocating drive. The positioning of these supporting means, which separately have to be re-adjusted, necessitates measurements and, if their adjustment to the mould side walls is imprecise, there is the danger that they can easily damage the strand skin which is still very thin at that point.

SUMMARY OF THE INVENTION

The invention aims at avoiding these disadvantages and difficulties and has as its object to provide a mould with supporting means of the kind described above, but which are detachable from the top side of the mould and always have the correct position relative to the side walls of the mould when the mould is re-adjusted to a different size, without necessitating manipulations below the mould.

According to the invention, this object is achieved in that the holding means are inserted in hollow spaces penetrating the mould side walls and extending up to the upper side of the mould side walls.

BRIEF DESCRIPTION OF THE DRAWINGS

The invention will now be described by way of an embodiment and with reference to the accompanying drawing, wherein.

DESCRIPTION OF AN EXEMPLARY EMBODIMENT

Figure 1:
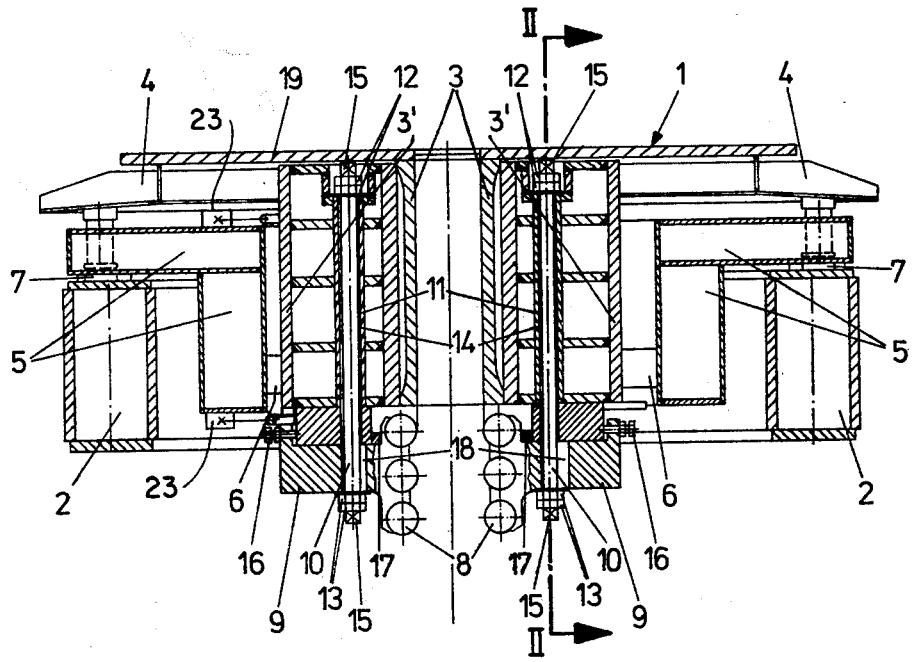
FIG. 1 is a transverse sectional view of the mould of a continuous casting plant for slabs.
Figure 2:
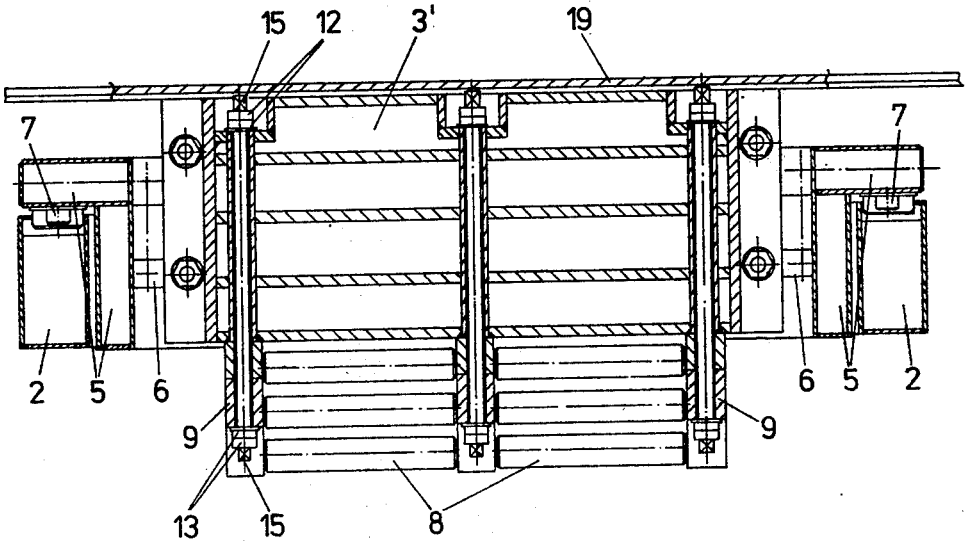
FIG. 2 is a section along line II—II of FIG 1.

In FIG. 1, the mould is denoted by 1, which mould is mounted on a frame-shaped lifting table 2. During the casting operation, the lifting table 2 is made to reciprocate vertically by a reciprocating drive not illustrated. The inner and outer mould side walls 3,3' can be parallelly displaced or brought into differently inclined positions, respectively, by means of spindles 23, for changing the size or format. A water box 5 carrying the mould side walls 3,3' via carriers 4 is in flow connection with the mould side walls 3,3' via conduits 6 and with the lifting table via conduits 7 and is arranged on the lifting table.

Directly below the mould side walls, foot rollers 8 for supporting the strand emerging from the mould are provided. Instead of the foot rollers, comb-like slide guides can be used. The foot rollers 8 are mounted in cheeks 9 which, according to the invention, are directly secured to the mould side walls by means of tension screws 10 or other holding means, such as, e.g. hammer head screws or drawing anchors. The tension screws 10 are inserted in hollow spaces 11 between the mould side walls 3,3' which spaces extend from the bottom to the top. The screws 10 are braced by nuts 12 at the side of the mould relative to nuts 13 screwed onto their lower ends. The hollow spaces 11 are formed by pipes 14 welded into the mould side walls. A square 15 provided at both ends of the tension screws 10 serves for fixing the tension screws, when the nuts 12 and 13 are tightened, whereby it is possible to fasten and release the tension screws from one side only, so that a single operator suffices. As has already been said, instead of the tension screws 10, drawing anchors fixable by wedges can be provided, e.g.

The cheeks 9 on which the foot rollers 8 are mounted, can be displaced relative to the inner walls 3 of the mould by means of adjustment screws 16 and spacers 17, so that a precise adjustment of the foot rollers to the inner walls 3 is possible. The recesses 18 in the cheeks 9 penetrated by the tension screws are provided with lateral play (FIG. 1) for this reason.

When the mould is assembled, the foot rollers are precisely adjusted in their position relative to the mould side walls. If the mould side walls are re-adjusted to a new strand size, the foot rollers secured thereto need not be readjusted. Therefore, no adjustment operations are necessary in the very narrow space slightly below the mould.

A cover plate 19 guards the upper side of the mould against splashes of steel.

If a break-through of the strand occurs directly below the mould, the tension screws 10 can be released from above, i.e. from the casting platform, after removal of the cover plate 19. Then the mould 1 can be moved upwardly through the frame-shaped lifting table 2. The foot rollers 8 that have welded together with the flowing steel remain the plant and do not impede the removal of the mould.

What I claim is:

1. In a mould arrangement to be used in a continuous casting plant, of the type including a mould having inner and outer side walls adjustable together to various strand dimensions, drive means for moving said side walls, strand supporting means arranged below the mould for supporting the strand emerging from the mould, and holding means releasable from above for securing the supporting means to the mould, the improvement which is characterized in that between the inner and outer side walls of the mould there are provided hollow spaces extending to the upper side of the side walls, the holding means being inserted in said hollow spaces so that movement of the mould walls by said drive means provides corresponding movement of the supporting means.

2. A mould arrangement as set forth in claim 1, wherein said holding means are tension screws.

3. A mould arrangement as set forth in claim 1, wherein said holding means are drawing anchors.

* * * * *

UNITED STATES PATENT AND TRADEMARK OFFICE

CERTIFICATE OF CORRECTION

PATENT NO. : 4,173,251

DATED : Nov. 6, 1979

INVENTOR(S) : Alois Scheinecker

It is certified that error appears in the above-identified patent and that said Letters Patent are hereby corrected as shown below:

First page, Item 30, "Australia" should read --Austria--.

Col. 2, line 14, "3, 3' " should read --3' --;

line 27, before "side" insert --upper--;

line 60, after "remain" insert --in--.

Signed and Sealed this

*Eleventh* Day of *March 1980*

[SEAL]

*Attest:*

SIDNEY A. DIAMOND

*Attesting Officer*

*Commissioner of Patents and Trademarks*